US009771805B2

(12) United States Patent
Subramaniyan et al.

(10) Patent No.: US 9,771,805 B2
(45) Date of Patent: Sep. 26, 2017

(54) SYSTEMS AND METHODS FOR VARYING A THROAT AREA BETWEEN ADJACENT BUCKETS IN A TURBINE FOR IMPROVED PART LOAD PERFORMANCE

(71) Applicant: General Electric Company, Schenectady, NY (US)

(72) Inventors: Moorthi Subramaniyan, Bangalore (IN); Jeyamani Doss, Bangalore (IN); Subodh Diwakar Deodhar, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 540 days.

(21) Appl. No.: 14/080,447

(22) Filed: Nov. 14, 2013

(65) Prior Publication Data

US 2015/0128612 A1 May 14, 2015

(51) Int. Cl.

| | |
|---|---|
| ***F01D 5/02*** | (2006.01) |
| ***F01D 5/14*** | (2006.01) |
| ***F01D 7/00*** | (2006.01) |
| ***F01D 17/16*** | (2006.01) |

(52) U.S. Cl.

CPC ..... *F01D 5/148* (2013.01); *F01D 7/00* (2013.01); *F01D 17/162* (2013.01); *F05D 2300/505* (2013.01); *F05D 2300/50212* (2013.01)

(58) Field of Classification Search

CPC . F01D 7/00; F01D 17/00; F01D 17/04; F01D 17/08; F01D 17/085; F01D 17/141; F01D 17/162; F01D 5/148; F01D 17/14

See application file for complete search history.

(56) References Cited

U.S. PATENT DOCUMENTS

| | | | | |
|---|---|---|---|---|
| 2,994,509 A * | 8/1961 | Walker | F01D 17/16 415/150 |
| 3,038,698 A * | 6/1962 | Troyer | F01D 5/148 415/12 |
| 8,210,799 B1 | 7/2012 | Rawlings | |
| 2009/0162189 A1 * | 6/2009 | Wagner | F01D 5/145 415/115 |
| 2010/0089468 A1 | 4/2010 | Scott et al. | |

FOREIGN PATENT DOCUMENTS

| | | | |
|---|---|---|---|
| GB | 2372296 A * | 8/2002 | F01D 5/148 |

* cited by examiner

*Primary Examiner* — Craig Kim
*Assistant Examiner* — Maxime Adjagbe
(74) *Attorney, Agent, or Firm* — Eversheds Sutherland (US) LLP

(57) ABSTRACT

A gas or steam turbine is disclosed herein. The turbine may include a throat area formed between adjacent buckets. The turbine also may include a variable throat device associated with at least one of the adjacent buckets. The variable throat device may be configured to vary the throat area between the adjacent buckets for improved part load performance.

8 Claims, 6 Drawing Sheets

SYSTEMS AND METHODS FOR VARYING A THROAT AREA BETWEEN ADJACENT BUCKETS IN A TURBINE FOR IMPROVED PART LOAD PERFORMANCE

FIELD

Embodiments of the disclosure relate generally to gas or steam turbines and more particularly relate to systems and methods for varying a throat area between adjacent buckets in a gas or steam turbine for improved part load performance.

BACKGROUND

During part load and hot day operations, gas and steam turbine rear stages may operate under severe off-design conditions due to reduced flow and pressure ratios. The conditions may result in efficiency losses. A contributing factor to this inefficiency is due to reduced enthalpy drop, which leads to inefficient operation of the turbine and/or the diffuser downstream thereof. One of the methods to increase the enthalpy drop during part load or hot day operations is via altering the last stage rotor blade (bucket). It would be desirable to modulate the throat area to stabilize the radial profile and other air flow properties in the turbine rear stages to increase efficiency during part load operation.

BRIEF DESCRIPTION

Some or all of the above needs and/or problems may be addressed by certain embodiments of the disclosure. According to one embodiment, there is disclosed a gas or steam turbine. The turbine may include a throat area formed between adjacent buckets. The turbine also may include a variable throat device associated with at least one of the adjacent buckets. The variable throat device may be configured to vary the throat area between the adjacent buckets for improved part load performance.

According to another embodiment, there is disclosed a gas or steam turbine system. The turbine system may include a compressor, a combustion system in communication with the compressor, and a turbine in communication with the combustion system. The turbine may include a throat area formed between adjacent buckets. The turbine also may include a variable throat device associated with at least one of the adjacent buckets. The variable throat device may be configured to vary the throat area between the adjacent buckets for improved part load performance.

Further, according to another embodiment, there is disclosed a method for increasing turbine efficiency during part load operation. The method may include positioning a variable throat device about a throat area between two adjacent buckets in a gas or steam turbine. The method also includes controlling a deflection of the variable throat device to vary the throat area between the adjacent buckets for improved part load performance.

Other embodiments, aspects, and features of the invention will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale.

DETAILED DESCRIPTION

Illustrative embodiments will now be described more fully hereinafter with reference to the accompanying drawings, in which some, but not all embodiments are shown. The disclosure may be embodied in many different forms and should not be construed as limited to the embodiments set forth herein. Like numbers refer to like elements throughout.

Figure 1:
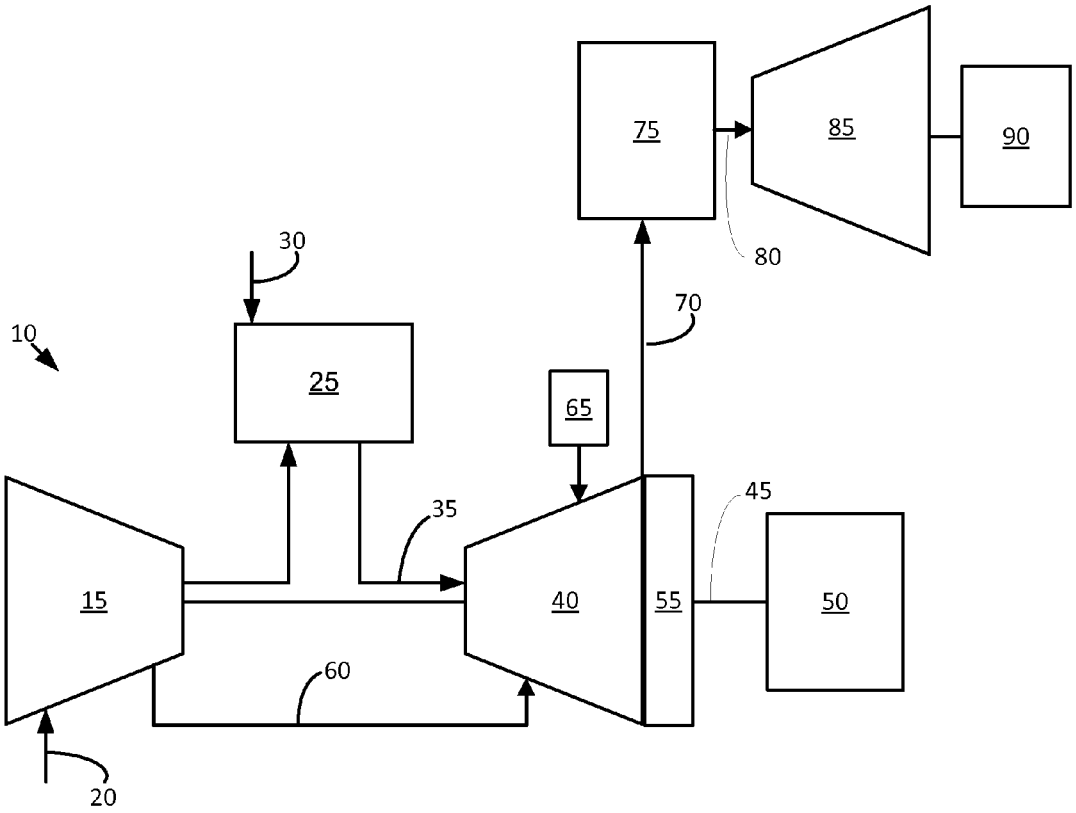
FIG. 1 schematically depicts an example view of a gas turbine engine assembly, according to an embodiment of the disclosure.

Illustrative embodiments of the disclosure are directed to, among other things, systems and methods for varying a throat area between adjacent buckets in a turbine. FIG. 1 shows a schematic view of gas turbine engine 10 as may be used herein. The gas turbine engine 10 may include a compressor 15. The compressor 15 compresses an incoming flow of air 20. The compressor delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. The flow of combustion gases 35 is in turn delivered to a downstream turbine 40. The flow of combustion gases 35 drives the turbine 40 to produce mechanical work. The mechanical work produced in the turbine 40 drives the compressor 15 via a shaft 45 and an external load 50, such as an electrical generator or the like.

A diffuser 55 downstream of the turbine rear stage may cooperate with the turbine 40. Generally described, the diffuser 55 may convert the kinetic energy of the hot flow combustion gases 35 exiting the rear stage into potential energy in the form of increased static pressure. In some instances, the diffuser 55 directs the hot flow gases through a casing of increasing area in the direction of the flow.

In some instances, an extraction circuit 60 may extract air flow from the compressor 15 to the turbine 40 to cool or heat the various component of the turbine 40. For example, the extraction circuit 60 may provide extraction air from the compressor 15 to the last stages of the turbine 15. In other instances, an external air source 65 may provide a flow of cooling or heating air to cool or heat the various component of the turbine 40.

In some instances, a heat recovery steam generator 75 may be in communication with at least a portion of the exhaust 70 from the turbine 40. The heat recovery steam generator 75 may generate steam 80. The steam 80 may be provided to a steam turbine 85. The steam 80 may drive the steam turbine 85 to produce mechanical work. The mechanical work produced in the steam turbine 85 may drive an external load 90, such as an electrical generator or the like.

The gas turbine engine 10 may use natural gas, various types of syngas, and/or other types of fuels. The gas turbine engine 10 may be anyone of a number of different gas turbine engines such as those offered by General Electric Company of Schenectady, New York and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
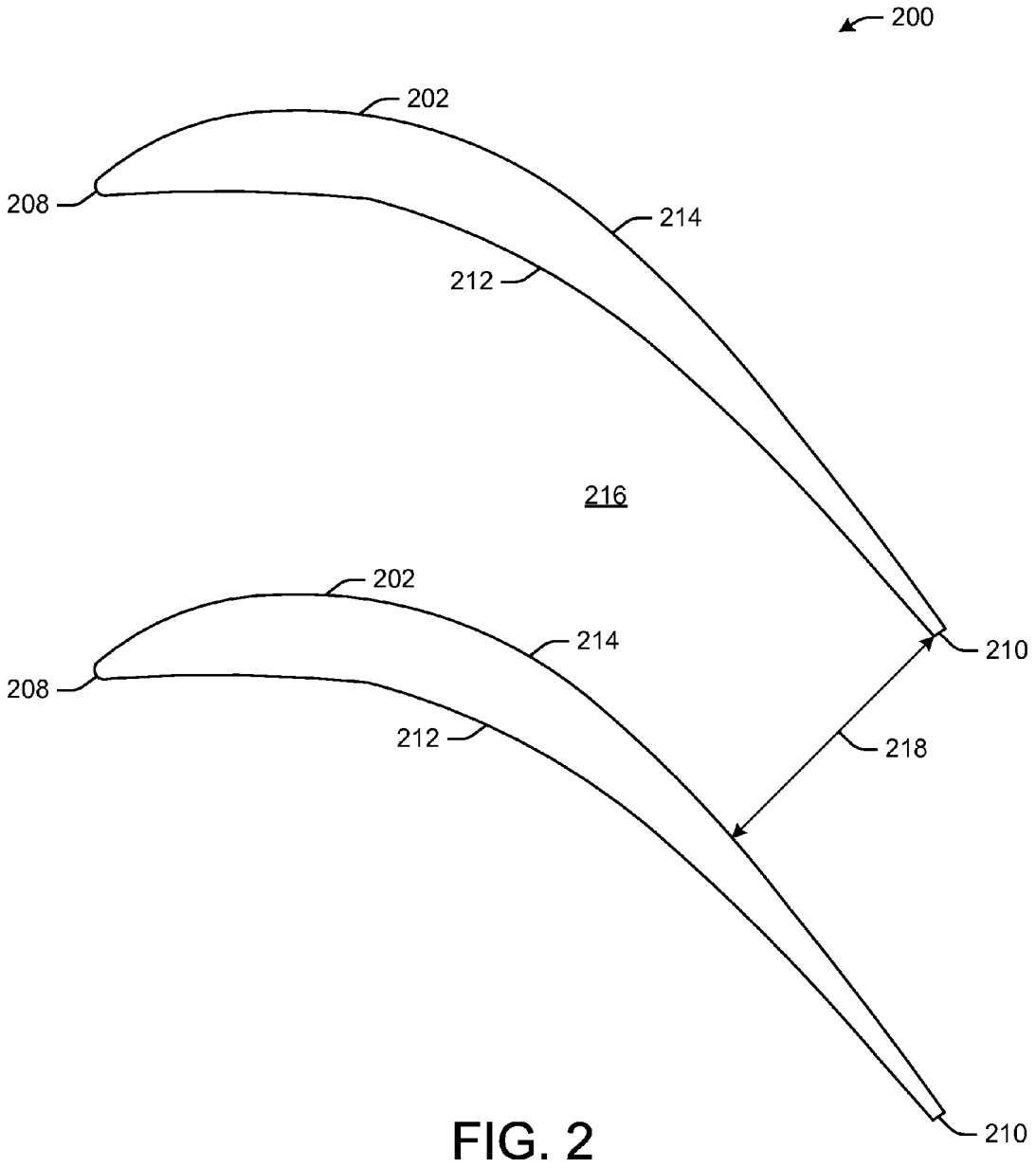
FIG. 2 schematically depicts an example view of a portion of a turbine, according to an embodiment of the disclosure.

FIG. 2 schematically depicts one example embodiment of a portion of a turbine 200. The turbine 200 may be a gas or steam turbine. The turbine 200 may include a number of buckets 202 positioned adjacent to one another to form a stage. In some instances, the buckets 202 may form the last stage of the turbine 200. Any number of buckets 202 may be used herein to form any stage of the turbine 200. For example, the buckets 202 may form a first stage, a last stage, or any stage there between. The buckets 202 may be attached to a rotor and circumferentially spaced apart from one another. Each of the buckets 202 may include a leading edge 208, a trailing edge 210, a pressure side 212, and a suction side 214. A passage 216 may be formed between adjacent buckets 202. The passage 216 may include a throat area 218. The throat area 218 is the shortest distance from the trailing edge 210 to the suction side 214 of adjacent buckets 202.

Figure 3A:
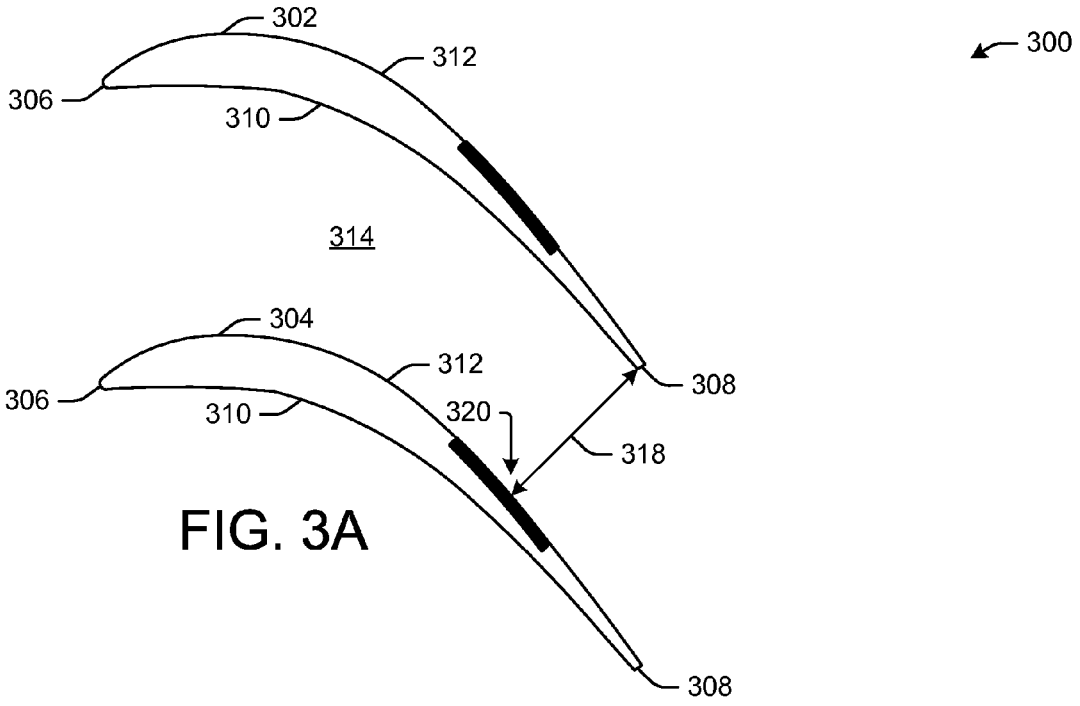
FIG. 3A schematically depicts an example view of a portion of a turbine, according to an embodiment of the disclosure.
Figure 3B:
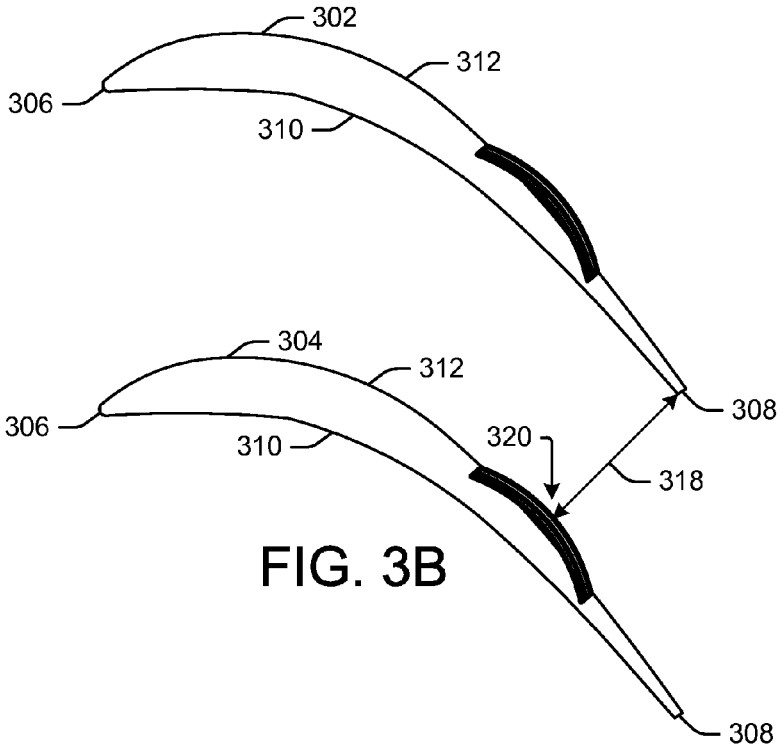
FIG. 3B schematically depicts an example view of a portion of a turbine, according to an embodiment of the disclosure.

FIGS. 3(*a*) and 3(*b*) schematically depicts one example embodiment of a number of adjacent buckets 300. In some instances, the buckets 300 may form the last stage of a gas or steam turbine. Although a number of buckets 300 may be used herein, only two are illustrated for simplicity. For example, the adjacent buckets 300 may include a first bucket 302 positioned adjacent to a second bucket 304. The first bucket 302 and the second bucket 304 may include a leading edge 306, a trailing edge 308, a pressure side 310, and a suction side 312. A passage 314 may be formed between the first bucket 302 and the second bucket 304. The passage 314 may include a throat area 318.

The second bucket 304 may include a variable throat device 320 configured to vary the throat area 318 between the first bucket 302 and the second bucket 304 for improved part load performance. For example, the variable throat device 320 may include a first configuration (as depicted in FIG. 3(*a*)) and a second configuration (as depicted in FIG. 3(*b*)). The variable throat device 320 may be configured to reduce the throat area 318 during part load operation, resulting in improved thermodynamic performance and diffuser recovery. In some instances, the variable throat device 320 may include a thermally dependent material configured to change shape to increase or decrease the throat area 318 between the first bucket 302 and second bucket 304. In one example, the thermally dependent material may be disposed about a suction side 312 of the second bucket 304. For example, the thermally dependent material may be disposed on the suction side 312 of the second bucket 304 opposite the trailing edge 308 of the first bucket 302.

Figure 4A:
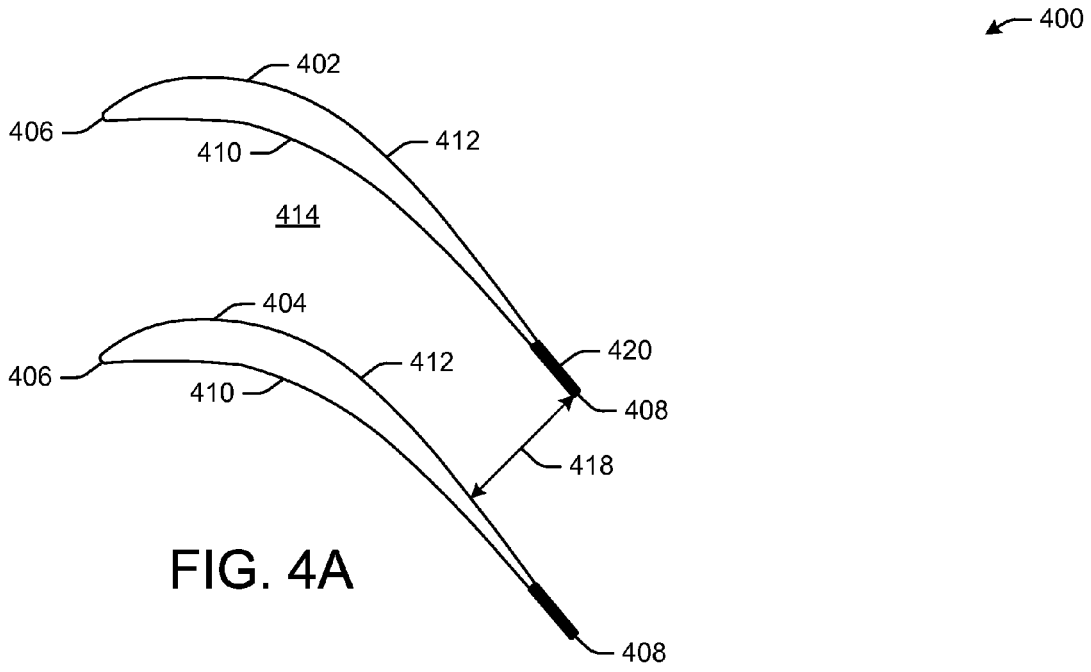
FIG. 4A schematically depicts an example view of a portion of a turbine, according to an embodiment of the disclosure.
Figure 4B:
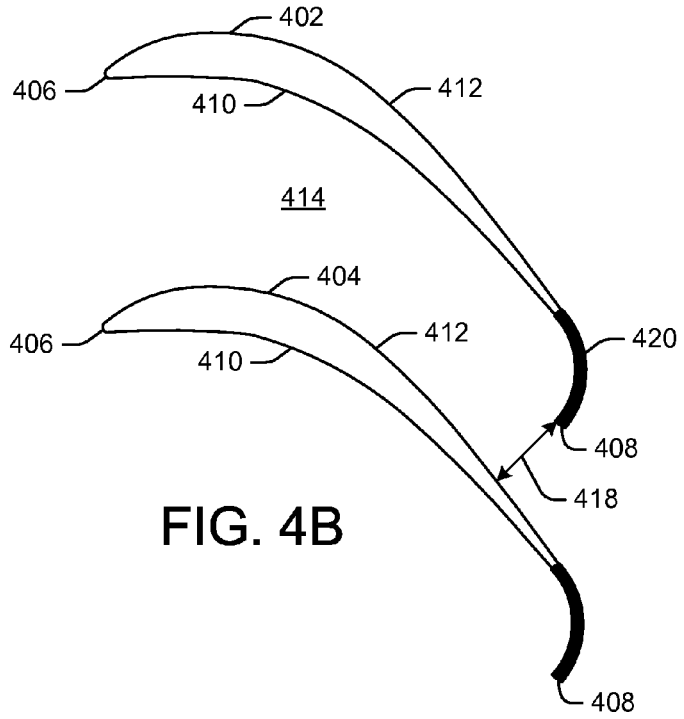
FIG. 4B schematically depicts an example view of a portion of a turbine, according to an embodiment of the disclosure.

FIGS. 4(*a*) and 4(*b*) schematically depicts one example embodiment of a number of adjacent buckets 400. In some instances, the buckets 400 may form the last stage of a gas or steam turbine. Although a number of buckets 400 may be used herein, only two are illustrated for simplicity. For example, the adjacent buckets 400 may include a first bucket 402 positioned adjacent to a second bucket 404. The first bucket 402 and the second bucket 404 may include a leading edge 406, a trailing edge 408, a pressure side 410, and a suction side 412. A passage 414 may be formed between the first bucket 402 and the second bucket 404. The passage 414 may include a throat area 418.

The first bucket 402 may include a variable throat device 420 configured to vary the throat area 418 between the first bucket 402 and the second bucket 404 for improved part load performance. For example, the variable throat device 420 may include a first configuration (as depicted in FIG. 4(*a*)) and a second configuration (as depicted in FIG. 4(*b*)). The variable throat device 420 may be configured to reduce the throat area 418 during part load operation, resulting in improved thermodynamic performance and diffuser recovery. In some instances, the variable throat device 420 may include a thermally dependent material configured to change shape to increase or decrease the throat area 418 between the first bucket 402 and second bucket 404. In one example, the thermally dependent material may be disposed about the trailing edge 408 of the first bucket 402. That is, the thermally dependent material may form the trailing edge 408 of the first bucket 402. In this manner, the thermally dependent material may change shape to vary the curvature of the trailing edge 408 of the first bucket 402. In some instances, as the curvature of the first bucket 402 varies, the throat area 418 may vary as well. For example, the throat area 418 may increase or decrease.

Figure 5A:
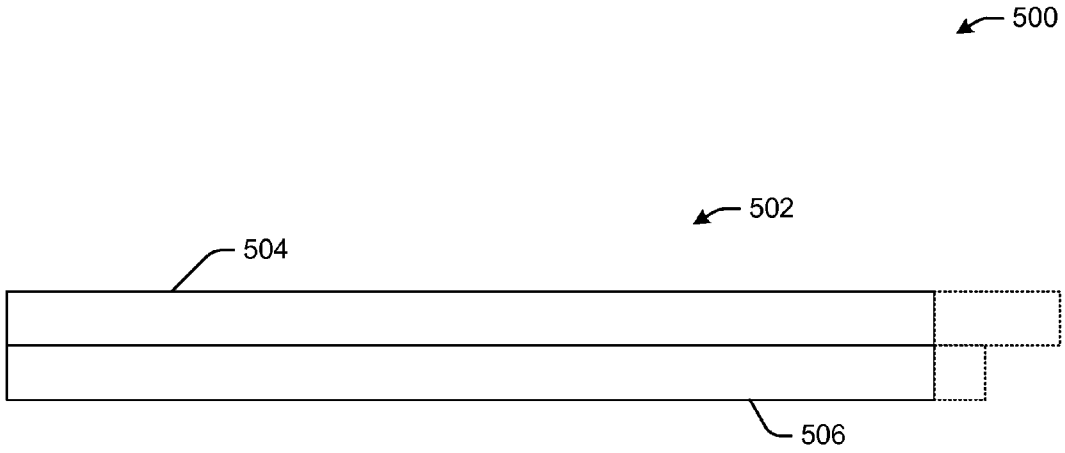
FIG. 5A schematically depicts an example view of a thermally dependent material, according to an embodiment of the disclosure.
Figure 5B:
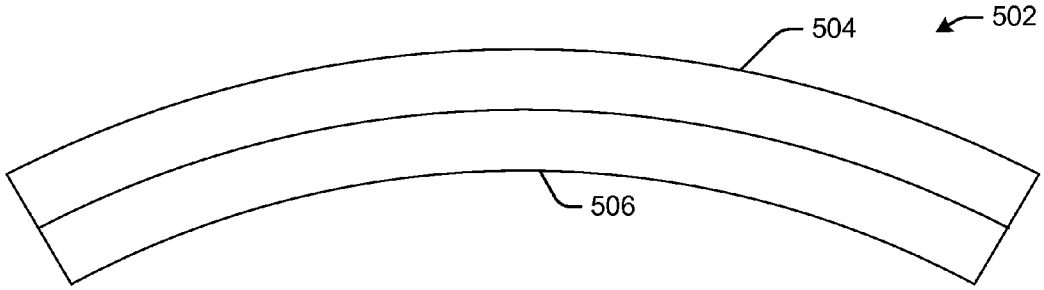
FIG. 5B schematically depicts an example view of a thermally dependent material, according to an embodiment of the disclosure.

FIGS. 5(*a*) and 5(*b*) schematically depicts one example embodiment of a thermally dependent material 500 as may be used herein as the variable throat device or the like. In some instances, the thermally dependent material 500 may be a bi-metallic strip 502, although any shape memory alloy device may be used. The bi-metallic strip 502 may include one or more layers of bi-metallic materials with different coefficients of thermal expansion. The bi-metallic strip 502 may include a first metal 504 and a second metal 506 in which the coefficient of thermal expansion of the first metal 504 is greater than the coefficient of thermal expansion of the second metal 506 or vice versa. The two metals may be bonded together along the at least a portion of their contacting surfaces. That is, the bi-metallic strip 502 may include two metals with different thermal expansion coefficients that are bonded together along the contact faces. When the metal temperature changes, the metals expand and/or contract differently, resulting in deflection of the bi-metallic strip 502 as seen in FIG. 5(*b*). A broad range of deflection levels can be achieved by altering materials, thickness, and/or expansion coefficients. The deflection (or lack thereof) of the bi-metallic strip 502 may vary the throat area between adjacent buckets.

The deflection of the bi-metallic strip 502 may be controlled in a number of ways. For example, the deflection of the bi-metallic strip 502 may be dependent on the temperature of the hot gasses or steam flowing through the turbine. In other instances, one or more internal heating and/or cooling flows may be in communication with the bi-metallic strip 502 by way of one or more internal passages within the buckets. For example, a diverted flow from the compressor (e.g., a cooling circuit) may be used to control the deflection of the bi-metallic strip 502. In addition, external or other air sources (or cooling circuits) may be used to control the deflection of the bi-metallic strip 502. For example, the bi-metallic strip 502 may be in communication with an induction heating device or the like. Any means may be used to control the deflection of the bi-metallic strip 502.

Figure 6:
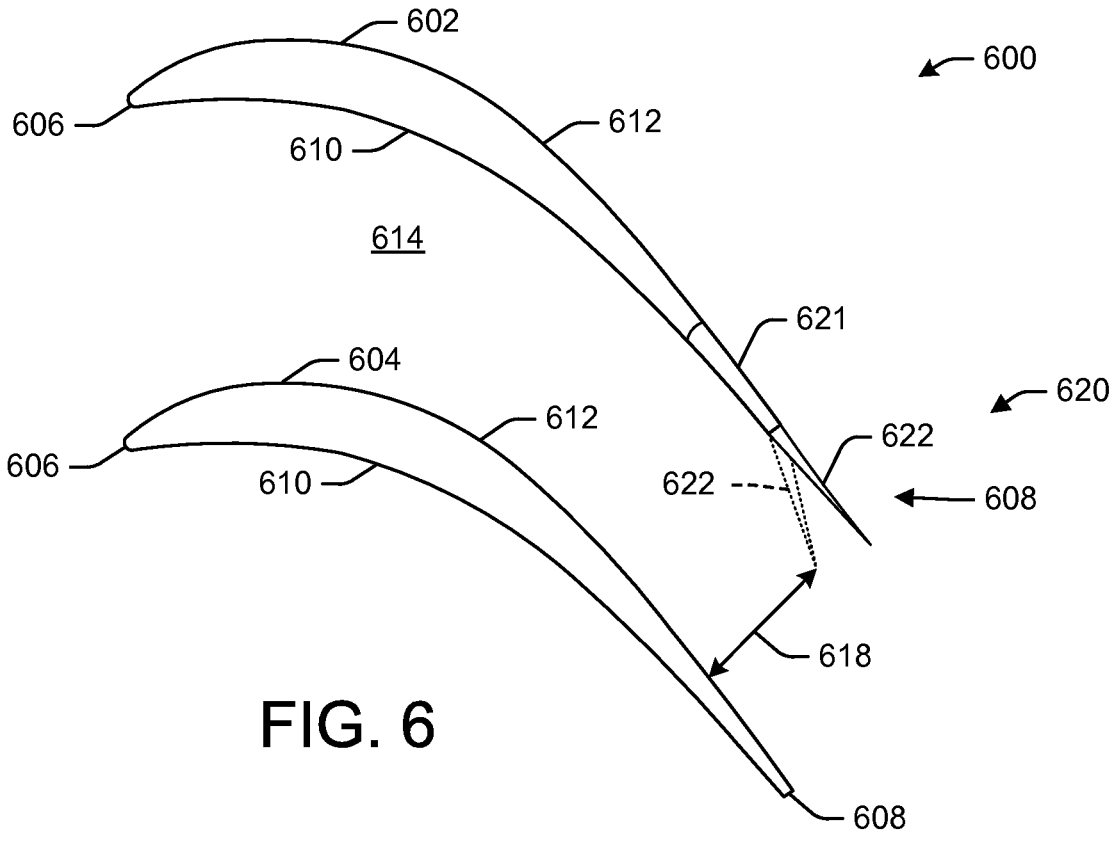
FIG. 6 schematically depicts an example view of a portion of a turbine, according to an embodiment of the disclosure.

FIG. 6 schematically depicts one example embodiment of a number of adjacent buckets 600. In some instances, the buckets 600 may form the last stage of a gas or steam turbine. Although a number of buckets 600 may be used herein, only two are illustrated for simplicity. For example, the adjacent buckets 600 may include a first bucket 602 positioned adjacent to a second bucket 604. The first bucket 602 and the second bucket 604 may include a leading edge 606, a trailing edge 608, a pressure side 610, and a suction side 612. A passage 614 may be formed between the first bucket 602 and the second bucket 604. The passage 614 may include a throat area 618.

The first bucket 602 may include a variable throat device 620 configured to vary the throat area 618 between the first bucket 602 and the second bucket 604. The variable throat device 620 may be configured to reduce the throat area 618 during part load operation, resulting in improved thermodynamic performance and diffuser recovery. In some instances, the variable throat device 620 may include a retractable strip 622 configured to extend and retract from a first configuration and a second configuration. When in the first configuration, the retractable strip 622 may be at least partially housed within the body of the first bucket 602. For example, the retractable strip 622 may be at least partially housed within housing 621. When in the second configuration, the retractable strip 622 may extend from the trailing edge 608 of the first bucket 602 towards the suction side 612 of the second bucket 604.

The extension and retraction of the retractable strip 622 may be controlled in a number of ways. For example, the retractable strip 622 may be a shape memory alloy or a bi-metallic strip. In other instances, the retractable strip 622 may be pneumatically controlled. For example, a diverted flow from the compressor may be used to control the extension and refraction of the retractable strip 622. Other air sources may also be used, including external air sources.

The described embodiments endeavor to maintain flow conditions in the turbine rear stage close to design parameters during part load operation. Throat area may be reduced as the turbine load or mass flow decreases in order to maintain suitable stage characteristics. This can be achieved either by having a variable device to reduce physical area or reduce the effective area via increasing the flow blockage. The methodology maintains pressure ratios across the turbine stages and improves expansion characteristics across the buckets. By maintaining flow conditions at the rear stage close to design parameters, turbine efficiency can be improved during part load operation.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A gas or steam turbine, comprising:

adjacent buckets comprising a first bucket and a second bucket, wherein the first bucket and the second bucket each comprise a leading edge, a trailing edge, a pressure side, and a suction side;

a throat area formed within a passage between the adjacent buckets, wherein the throat area comprises the shortest distance from the trailing edge of the first bucket to the suction side of the second bucket; and a variable throat device comprising a bi-metallic strip disposed at the throat area on the suction side of the second bucket between the leading edge and trailing edge of the second bucket and directly opposite the trailing edge of the first bucket, wherein the variable throat device is configured to bulge towards and contract away from the trailing edge of the first bucket to vary the throat area between the adjacent buckets for improved part load performance.

2. The turbine of claim 1, wherein the bi-metallic strip is formed from one or more layers of bi-metallic materials with different coefficients of thermal expansion.

3. The turbine of claim 1, wherein the adjacent buckets comprise last stage buckets.

4. The turbine of claim 1, wherein the variable throat device is at least partially controlled by an external source of air or compressor extraction air.

5. A gas or steam turbine system, comprising:

a compressor;

a combustion system in communication with the compressor; and a turbine in communication with the combustion system, wherein the turbine comprises:

adjacent buckets comprising a first bucket and a second bucket, wherein the first bucket and the second bucket each comprise a leading edge, a trailing edge, a pressure side, and a suction side;

a throat area formed within a passage between the adjacent buckets, wherein the throat area comprises the shortest distance from the trailing edge of the first bucket to the suction side of the second bucket; and a variable throat device comprising a bi-metallic strip disposed at the throat area on the suction side of the second bucket between the leading edge and trailing edge of the second bucket and directly opposite the trailing edge of the first bucket, wherein the variable throat device is configured to bulge towards and contract away from the trailing edge of the first bucket to vary the throat area between the adjacent buckets for improved part load performance.

6. The system of claim 5, wherein the bi-metallic strip is formed from one or more layers of bi-metallic materials with different coefficients of thermal expansion.

7. The system of claim 5, wherein the adjacent buckets comprise last stage buckets.

8. A gas or steam turbine, comprising:

adjacent buckets comprising a first bucket and a second bucket, wherein the first bucket and the second bucket each comprise a leading edge, a trailing edge, a pressure side, and a suction side;

a throat area formed within a passage between the adjacent buckets, wherein the throat area comprises the shortest distance from the trailing edge of the first bucket to the suction side of the second bucket; and a bi-metallic strip disposed at the throat area on a suction side of the second bucket between the leading edge and trailing edge of the second bucket and directly opposite the trailing edge of the first bucket, wherein the bi-metallic strip is configured to bulge towards and contract away from the trailing edge of the first bucket to vary the throat area between the adjacent buckets for improved part load performance, wherein the bi-metallic strip is at least partially controlled by an external source of air or compressor extraction air.

* * * * *